United States Patent [19]

Greenawalt

[11] 4,067,324

[45] Jan. 10, 1978

[54] THERAPEUTIC APPARATUS FOR STIMULATION OF ACUPUNCTURE MERIDIANS

[76] Inventor: Monte H. Greenawalt, 1901 Rockdale Road, Dubuque, Iowa 52001

[21] Appl. No.: 696,607

[22] Filed: June 16, 1976

[51] Int. Cl.[2] ..... A61H 15/00

[52] U.S. Cl. ..... 128/57

[58] Field of Search ..... 128/57, 25 B, 67, 24.3

[56] References Cited

U.S. PATENT DOCUMENTS

| | | | |
|---|---|---|---|
| 718,594 | 1/1903 | Bailey | 128/57 |
| 1,688,764 | 10/1928 | Trankowski et al. | 128/57 |
| 1,811,764 | 6/1931 | Sherwood | 128/57 X |
| 2,699,164 | 1/1955 | Stauffer | 128/57 |
| 3,037,500 | 6/1962 | Daugherty | 128/57 |
| 3,662,748 | 5/1972 | Thurman | 128/25 B |
| 3,664,334 | 5/1972 | O'Neil | 128/57 |
| 3,744,483 | 7/1973 | Picolin | 128/25 B |
| 3,970,078 | 7/1976 | Rogers | 128/57 |

*Primary Examiner*—Lawrence W. Trapp
*Attorney, Agent, or Firm*—Henderson, Strom & Sturm

[57] ABSTRACT

An elongated, cylindrical support member. Attached to the support member intermediate the ends thereof are a plurality of annular roller members. Handle members are attached over each end of the support member. Each roller member bears a plurality of uniformly spaced, radially disposed projections. Engagement of the skin of an individual by the projections, when the support member is moved with respect to the body of the individual, effects a stimulation of the acupuncture points located thereon.

1 Claim, 3 Drawing Figures

THERAPEUTIC APPARATUS FOR STIMULATION OF ACUPUNCTURE MERIDIANS

BACKGROUND OF THE INVENTION

This invention relates generally to acupuncture points and apparatus and techniques employed in operations performed thereon. This invention also relates to roller-type apparatus.

Acupuncture is an ancient Chinese art of puncturing the body with long, fine gold or silver needles to relieve pain and cure disease. Apparatus have been designed which bear a reciprocating needle, which needle is employed to apply repeated stimulation to an acupuncture point. The application of acupuncture as an anesthetic technique is the usage which has most interested Western doctors.

In view of the popularity of acupuncture therapy in the world today, much research has been undertaken. It has been found that the acupuncture meridians of the body can be influenced in various ways, the insertion of acupuncture needles being but one method. Repeated stimulation of acupuncture points has been shown to result in beneficial effects upon the body.

An apparatus which would enable an individual to easily stimulate the acupuncture meridians of his body would be desirable. A number of roller devices have been developed which enable an individual to self-massage certain muscles, but none of these roller devices are capable of stimulating acupuncture points.

SUMMARY OF THE INVENTION

A therapeutic apparatus for stimulation of acupuncture meridians includes an elongated, cylindrical support. The support has defined thereon, by a pair of longitudinally spaced collars, three bearing portions. Handles are attached over the bearing portions adjacent each end of the support. A plurality of rollers are attached over the central bearing portion. Each of the rollers are annular in shape and bear on the outer surface thereof a plurality of radially spaced, outwardly disposed pointed members. The rollers rotate upon the central bearing surface when the support is moved with respect to the body of the individual to whom the therapeutic apparatus is applied, the pointed members engaging the skin and stimulating the acupuncture points thereon.

It is an object of this invention to provide a therapeutic apparatus which is economical of manufacture and which may be easily applied by an individual to himself.

Another object of this invention is to provide a therapeutic apparatus which effectively stimulates the acupuncture points of the body.

Yet another object of this invention is to provide a therapeutic apparatus which can massage the body while stimulating acupuncture points thereof.

These objects and other features and advantages of the therapeutic apparatus for stimulation of acupuncture meridians will become readily apparent upon referring to the following description, when taken in conjunction with the appended drawing.

BRIEF DESCRIPTION OF THE DRAWING

The therapeutic apparatus, for stimulation of acupuncture meridians, of this invention is illustrated in the drawing wherein.

DESCRIPTION OF THE PREFERRED EMBODIMENT

Figure 1:
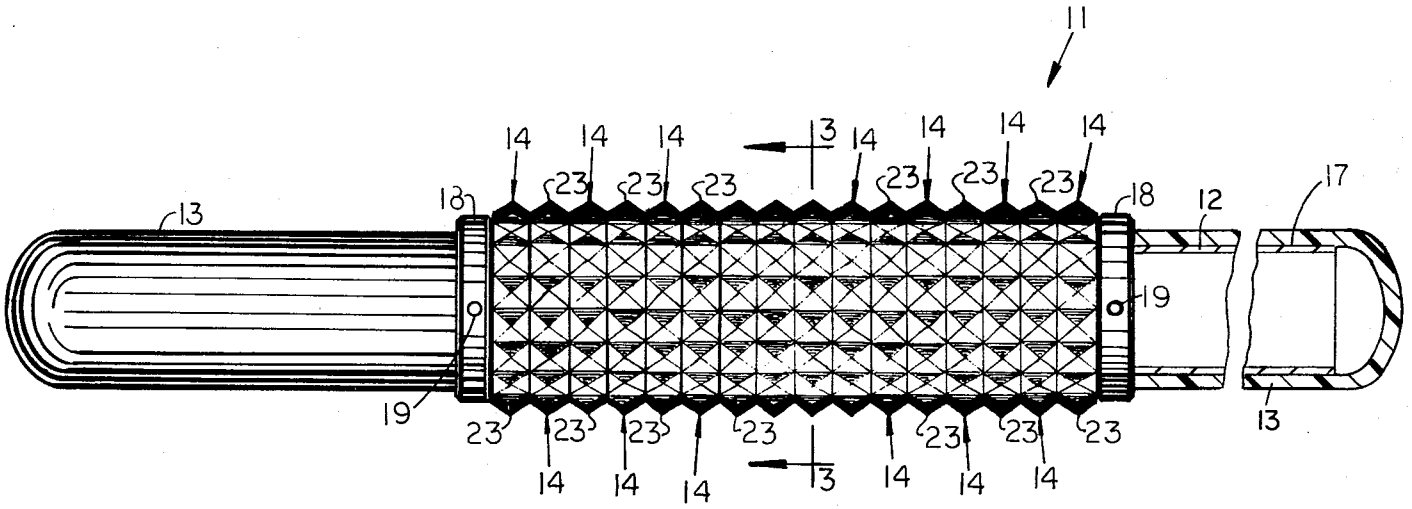
FIG. 1 is a front elevational view of the therapeutic apparatus, the right-hand portion thereof being shown in vertical section.

The therapeutic apparatus, for stimulation of acupuncture meridians, of this invention is indicated generally at 11 in FIG. 1. The therapeutic apparatus 11 more particularly includes a support member 12, handle members 13 and roller units 14.

Figure 3:
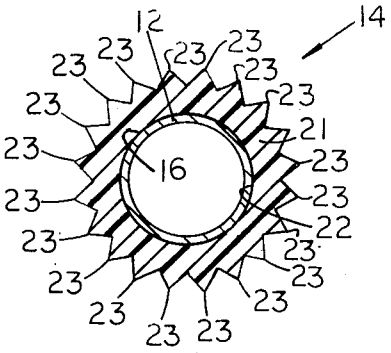
FIG. 3 is a sectional view of the therapeutic apparatus taken along line 3—3 of FIG. 1.

Referring now to FIGS. 1 and 3, the support member 12 is elongated and cylindrical in conformation. The exterior surface of the support member 12 forms a central bearing portion 16 and right and left handle-bearing portions 17 on each side of portion 16 and adjacent the ends of member 12, only the right handle-bearing portion 17 being shown in the drawings. A pair of annular-shaped collar members 18 are attached to the support member 12 as by screws, bolts or rivets 19. The collar members 18 are spaced apart along the length of the support member 12 and divide the exterior surface of the member 12 into central and handle-bearing portions 16, 17.

Figure 2:
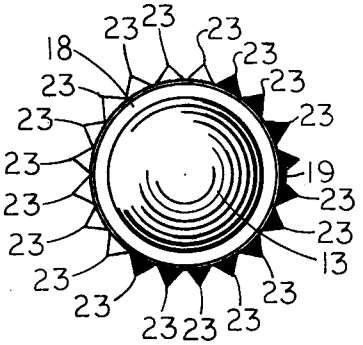
FIG. 2 is an end elevational view of the therapeutic apparatus.

Referring to FIGS. 1 and 2, a pair of handle members 13 are attached to the support member 12. Each handle member 13 is slidably attached over one end of the support member 12, the handle member 13 resting upon a handle-bearing portion 17 and abutting a collar member 18.

Referring again to FIGS. 1 and 3, a plurality of roller units 14 are arranged in side-by-side fashion and attached to the support member 12. Each roller unit 14 is substantially annular in configuration, having a ring portion 21. The interior surface of the ring portion 21 forms an inner bearing surface 22. The exterior of the ring portion 21 has formed thereon a plurality of members 23. Each of the members 23 is pyramidal in conformation, having four sides and tapering to a point. Each of the members 23 is as wide as the exterior or interior of the ring portion 21. The members 23 abut each other and extend radially away from the center of the unit 14. The inner surfaces 22 of the roller units 14 are disposed against the central bearing surface 16 of the support member 12, and the units 14 are disposed between the collar members 18. The roller units 14 extend outwardly from the support member 12 farther than the collar members 18, the members 23 extending beyond the outermost surface of the members 18, as shown in FIG. 2.

When the therapeutic apparatus 11 is assembled, the roller units 14 are slid onto the support member 12, and the collar members 18 are slid over the ends of the member 12 such that the units 14 are between the members 18 and the units 14 and members 18 are in abutment. The roller units 14 and collar members 18 are moved together along the length of the support member until properly positioned. Rivets, bolts or screws 19 then rigidly affix the collar members 18 to the support member 12.

Alternately, one collar member 18 is slid onto the support member 12, properly positioned and then rigidly affixed thereto by a rivet, bolt or screw 19. The roller units 14 are then slid onto the member 12 until in abutment with the collar member 18 and positioned over the central bearing surface 16. The second collar member 18 is then affixed to the member 12, the roller units 14 being held upon the member 12 between the collar members 18.

The handle members 13 are attached over the bearing surfaces 17 after the roller units 14 and collar members 18 have been attached to the support member 12.

When the therapeutic apparatus 11 is to be used, either the individual upon whom the apparatus 11 is to be employed or, depending upon the portion of the body of the individual which the therapeutic apparatus 11 is to be applied, another person grasps the handle members 13. The roller units 14 are positioned against the body, and the therapeutic apparatus 11 is moved back and forth over the body. The members 23 of roller units 14 engage the skin, the inner bearing surfaces 22 moving over the bearing portion 16 to allow the roller units 14 to rotate about the support member 12. The abutting side surfaces of the individual roller units 14 are slidable with respect to each other such that, if the members 23 of one roller unit 14 become disengaged from the skin due to the contour of the body and cause that roller unit 14 to cease rotating about member 12, adjacent roller units 14 having members 23 still in engagement with the skin may still rotate about the member 12.

The therapeutic apparatus 11 is applied to those parts of the body bearing acupuncture meridians. Where an individual has a tension headache, application of the apparatus to the back of the neck of the individual, between base of the skull and shoulders, and thereafter across the shoulders significantly reduces the duration of the headache. Other areas bearing concentrations of acupuncture points to which the apparatus can be applied to aid an individual in relaxing are upon the forearms adjacent the elbows, on the top and bottom of both wrists, on the web between the thumb and forefinger of both hands, on the inside and outside of both knees, on the fat portion of both calf muscles, and on each side of both feet immediately below the ankle bone.

Stimulation of the acupuncture points is effected by the members 23. Application of the apparatus 11 also stimulates the capillaries, causing a beneficial flow of blood to areas adjacent the surface skin. The apparatus 11 also has a massaging effect which, since combined with stimulation of acupuncture points, renders the apparatus 11 more effective in treating cramped muscles.

The preferred width of a roller member 14 is about $\frac{1}{4}$ inch (0.64 cm). A large number of roller members 14 may then be disposed upon the bearing portion 16. The preferred internal diameter of a roller member 14 is about $\frac{7}{8}$ inch (2.22 cm), and the preferred external diameter (between tips of diametrically opposed members 23) is about $1\frac{1}{2}$ inch (3.81 cm). The members 23 abut and completely cover the outer surface of ring 21. Twenty members 23 have been illustrated for each roller member 14. Effective, repeated stimulation of acupuncture points of the body, and particularly along the acupuncture meridians of the body, is ensured by the large number of members 23 brought to engagement with the skin, and the concentration of members 23 due to the narrowness of the individual roller members 14. The size of the roller members 14 also enable small areas having concentrations of acupuncture points, such as the web between the thumb and forefinger, to be easily reached. Since the roller members 14 may rotate about the support member 12 independently of each other, engagement of the members 23 with the skin, and therefore stimulation of the acupuncture points, is ensured when therapeutic apparatus 11 is drawn over uneven body surfaces.

The therapeutic apparatus 11 is more easily drawn over the body because only those roller units 14 which must turn are actually turning upon the bearing surface 16. Also, the handle members 13 may be further elongated such that the individual himself may apply the therapeutic apparatus 11 to difficult to reach areas of his back.

It can be seen that the objects of this invention have been attained. Furthermore, although a preferred embodiment has been disclosed herein, it is to be remembered that various modifications and alternate constructions can be made thereto without departing from the full scope of the invention, as defined in the claims.

I claim:

1. A therapeutic apparatus for stimulating acupuncture points of the body, said apparatus comprising:

elongated support means;

a pair of handle members, each handle member being slidably affixed over one end of said support means;

a plurality of roller means for stimulating acupuncture points, said roller means being rotatably attached to and disposed in side-by-side relationship upon said support means and between said handle means, each of said roller means being independently rotatable about said support means; and each of said roller means being annular in shape and having inner, outer and side surfaces, said inner surface being disposed against said support means, said side surfaces interconnecting said inner and outer surfaces, said roller means having a plurality of radially and outwardly directed projections formed upon said outer surface, each of said projections spanning the width of said outer surface, being pyramidal in configuration, and abutting with adjacent projections, said projections completely covering said outer surface and engaging the body to stimulate the acupuncture points thereof when said support means is moved with respect to the body.

* * * * *